US008004427B2

(12) United States Patent
Goodman et al.

(10) Patent No.: US 8,004,427 B2
(45) Date of Patent: Aug. 23, 2011

(54) SYSTEM AND METHOD FOR COMMUNICATING AN AIRCRAFT'S INTENDED PATH TO THE RUNWAY TO DIRECT THE AIRCRAFT ALONG THE RUNWAY

(75) Inventors: William L. Goodman, Coupeville, WA (US); Syed Taji Shafaat, Everett, WA (US)

(73) Assignee: The Boeing Company, Chicago, IL (US)

( * ) Notice: Subject to any disclaimer, the term of this patent is extended or adjusted under 35 U.S.C. 154(b) by 254 days.

(21) Appl. No.: 12/146,052

(22) Filed: Jun. 25, 2008

(65) Prior Publication Data

US 2009/0323320 A1 Dec. 31, 2009

(51) Int. Cl.
*G08B 21/00* (2006.01)

(52) U.S. Cl. ..... 340/945; 340/947; 340/951; 340/955; 340/961; 342/29; 342/36; 701/3

(58) Field of Classification Search ..... 340/945, 340/947, 948, 951, 972, 815.4, 955, 961; 342/29, 36, 450; 701/35, 120, 207, 3; 703/13, 703/14

See application file for complete search history.

(56) References Cited

U.S. PATENT DOCUMENTS

| | | | | |
|---|---|---|---|---|
| 3,706,969 | A * | 12/1972 | Paredes | 340/989 |
| 5,968,106 | A * | 10/1999 | DeVlieg et al. | 701/70 |
| 6,694,249 | B1 | 2/2004 | Anderson et al. | |
| 6,751,545 | B2 | 6/2004 | Walter | |
| 6,789,010 | B2 | 9/2004 | Walter | |
| 6,950,037 | B1 * | 9/2005 | Clavier et al. | 340/945 |
| 7,626,513 | B2 * | 12/2009 | Goodman et al. | 340/945 |
| 7,629,601 | B2 * | 12/2009 | Glassner et al. | 250/552 |
| 2006/0227014 | A1 * | 10/2006 | Gannon | 340/972 |
| 2008/0007430 | A1 * | 1/2008 | Wang et al. | 340/947 |
| 2008/0204280 | A1 * | 8/2008 | Reason et al. | 340/955 |

* cited by examiner

*Primary Examiner* — Hung T. Nguyen

(74) *Attorney, Agent, or Firm* — Klintworth & Rozenblat IP LLC

(57) ABSTRACT

In a method of dynamically guiding an aircraft the intended path of the aircraft may be broadcast along at least one of a runway and a taxiway. The broadcasted intended path of the aircraft along the at least one runway and taxiway may be received. The lighting characteristics of an airport lighting device along the at least one runway and taxiway may be dynamically changed to dynamically guide the aircraft along the broadcasted and received intended path of the at least one runway and taxiway.

32 Claims, 4 Drawing Sheets

SYSTEM AND METHOD FOR COMMUNICATING AN AIRCRAFT'S INTENDED PATH TO THE RUNWAY TO DIRECT THE AIRCRAFT ALONG THE RUNWAY

BACKGROUND

Many, if not all, of today's systems and methods for guiding aircraft over taxiways and/or runways during departure and/or landing utilize constant lighting of runways and/or taxiways. This may include constant lighting of runway and taxiway centerlines, constant lighting of lead-out taxiway exit lines, constant lighting of runway lead-in lines, and/or constant lighting of other parts of the runways and/or taxiways. However, many if not all of these systems and methods may not dynamically change the lighting characteristics of the runway and/or taxiway lighting to dynamically guide the particular aircraft over the intended runway and/or taxiway path intended for that particular aircraft. This may lead to decreased efficiency and congestion on the runways and/or taxiways.

A system and/or method is needed to decrease one or more problems associated with one or more of the existing systems and/or methods for guiding an aircraft.

SUMMARY

In one aspect of the disclosure, a airport lighting system may include: a broadcast device for broadcasting an intended path of an aircraft along at least one of a runway and a taxiway; a receiving device for receiving the broadcasted intended path of the aircraft along the at least one runway and taxiway; and an airport lighting device for dynamically changing lighting characteristics of the airport lighting device along the at least one runway and taxiway in order to dynamically guide the aircraft along the broadcasted and received intended path of the at least one runway and taxiway.

In another aspect of the disclosure, a method of dynamically guiding an aircraft is provided. In one step, an intended path of the aircraft may be broadcast along at least one of a runway and a taxiway. In another step, the broadcasted intended path of the aircraft along the at least one runway and taxiway may be received. In an additional step, the lighting characteristics of an airport lighting device along the at least one runway and taxiway may be dynamically changed to dynamically guide the aircraft along the broadcasted and received intended path of the at least one runway and taxiway.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
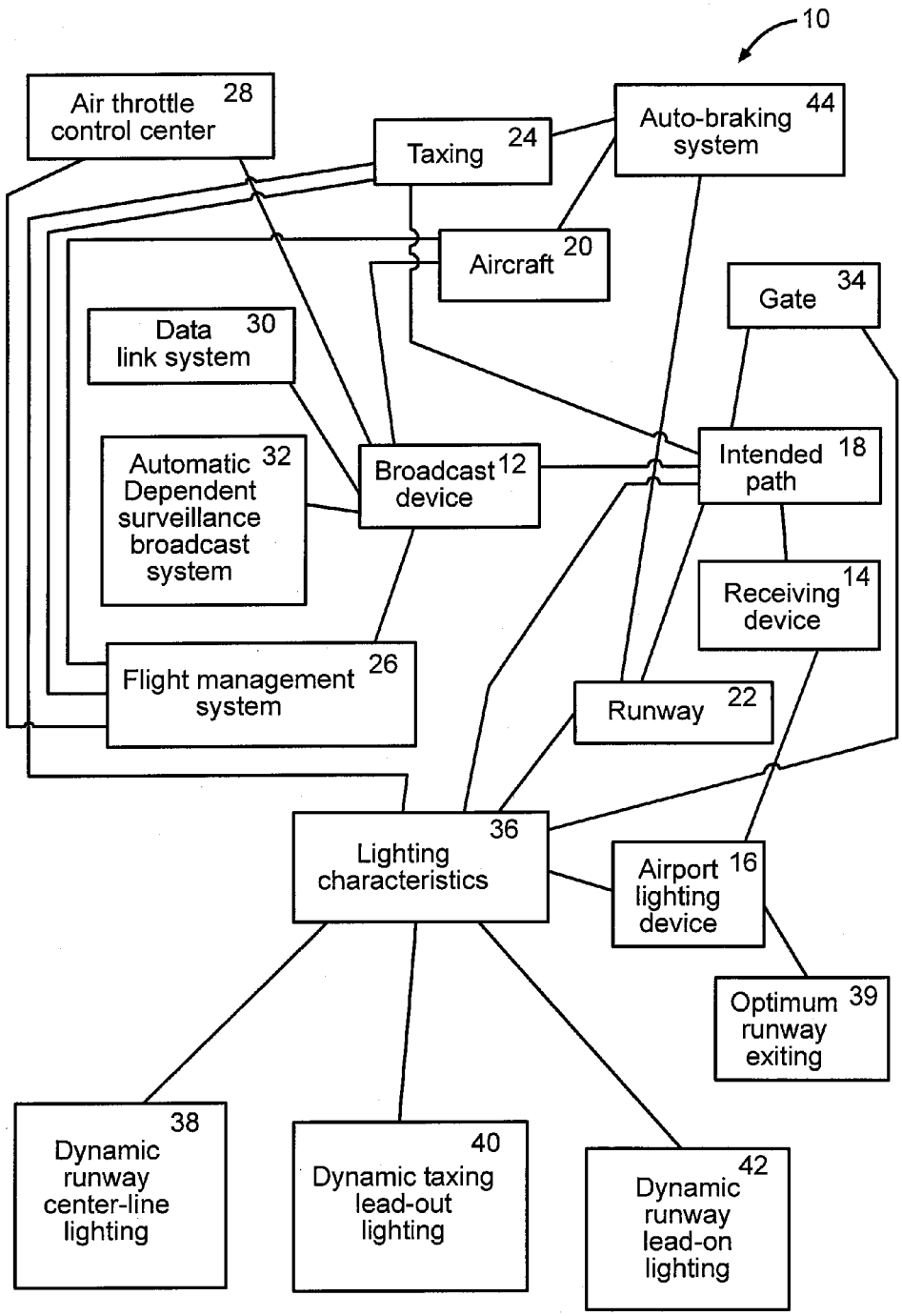
FIG. 1 shows a box diagram of one embodiment of an airport lighting system.

FIG. 1 shows a box diagram of one embodiment of an airport lighting system 10 comprising a broadcast device 12, a receiving device 14, and an airport lighting device 16. The broadcast device 12 may comprise a transmitter/broadcaster for broadcasting an intended path 18 of an aircraft 20 along one or more of a runway 22 and/or taxiway 24. The broadcast device 12 may comprise a flight management system 26, may be disposed on the aircraft 20, and/or may be disposed in an air traffic control center 28. The broadcast device 12 may utilize a data-link system 30, an automatic dependent surveillance broadcast system 32, and/or another type of device or system. The broadcast device 12 may be used to broadcast an identification of the aircraft 20, a location of the aircraft 20, and/or the intended path 18 of the aircraft 20 along the one or more runway 22 and/or taxiway 24.

The intended path 18 of the aircraft 20 may comprise at least one of the specific runways 22 and/or the specific taxiways 24 the aircraft 20 intends to take during at least one of push-off from a gate 34, taxing to the runways 22, moving over the runways 22 to arrive at a take-off runway 22, landing on a landing runway 22, moving over the runways 22 to arrive at a taxiway 24, and moving over the taxiways 24 to arrive at a destination gate 34. In one embodiment, the intended path 18 of the aircraft 20 may include the precise entire departure path of the aircraft 20 from pushing off from a specific gate 34, to taxing along a certain order of particular taxiways 24, to moving along a certain order of particular runways 22, to taking off from a particular take-off position on a particular runway 22. In another embodiment, the intended path 18 of the aircraft may include the precise entire arrival/landing path of the aircraft 20 from landing at a particular landing position on a specific landing runway 22, to moving over a certain order of particular runways 22, to taxing along a certain order of taxiways 24, to arriving at a certain destination gate 34.

The receiving device 14 may comprise a receiver for receiving the broadcasted intended path 18 of the aircraft 20 along the one or more runway 22 and/or taxiway 24. The receiving device 14 may be attached to and/or connected to the airport lighting device 16. The receiving device 14 may be used to receive the identification of the aircraft 20, the location of the aircraft 20, and/or the intended path 18 of the aircraft 20 along the one or more runway 22 and/or taxiway 24.

The airport lighting device 16, which may comprise any numbers of and types of lighting devices capable of illumination, may be adapted to dynamically change its lighting characteristics 36 along the one or more runway 22 and/or taxiway 24 in order to dynamically guide the aircraft 20 along the broadcasted and received intended path 18 of the one or more runway 22 and/or taxiway 24. The airport lighting device 16 may be adapted to dynamically change its lighting characteristics 36 to provide dynamic runway center-line lighting 38 to light up a center-line of the runway 22, to light up another portion of the runway 22, to light up an indication, to light up directions, and/or to light up written directions for the aircraft 20 to follow one or more runways 22 along the intended path 18. The airport lighting device 16 may be adapted to dynamically change its lighting characteristics 36 to provide dynamic taxiway lead-out lighting 40 to light up a portion of the taxiway 24 and/or runway 22, to light up an indication, to light up written directions, and/or to light up visual directions for the aircraft 20 to follow to get onto or off of a taxiway 24 in order to follow the intended path 18. The airport lighting device 16 may also be adapted to dynamically change its lighting characteristics 36 to provide dynamic runway lead-on lighting 42 to light up a portion of the taxiway 24 and/or runway 22, to light up an indication, to light up written directions, and/or to light up visual directions to guide the aircraft 20 onto, off of, and/or along a runway 22 on the intended path 18. The airport lighting device 16 may be adapted to dynamically change its lighting characteristics 36 by at least one of increasing lighting intensity, sequential flashing, flashing, color enhancements, enhancements, lighting up arrow directions, lighting up word directions, and lighting up path directions in order to dynamically guide the aircraft 20 along the intended path 18.

The aircraft 20 may comprise an autobraking system 44 which is pre-programmed to exit a landing runway 22 at a pre-defined landing runway taxiway 24 exit. The airport lighting device 16 may utilize optimum runway exiting 39 to exit the aircraft 20 off a landing runway 22 to a taxiway 24 as quickly as possible.

In one embodiment, the airport lighting device 16 may be adapted to dynamically change its lighting characteristics 36 to dynamically guide the aircraft 20 along its entire intended path 18 of departure including pushing off from a specific gate 34, taxing along a certain order of particular taxiways 24, moving along a certain order of particular runways 22, and taking off from a particular take-off position on a particular runway 22. In another embodiment, the airport lighting device 16 may be adapted to dynamically change its lighting characteristics 36 to dynamically guide the aircraft 20 along its entire intended path 18 of arrival/landing from arriving/landing at a particular landing position on a specific landing runway 22, to moving over a certain order of particular runways 22, to taxing along a certain order of taxiways 24, to arriving at a certain destination gate 34.

Figure 2:
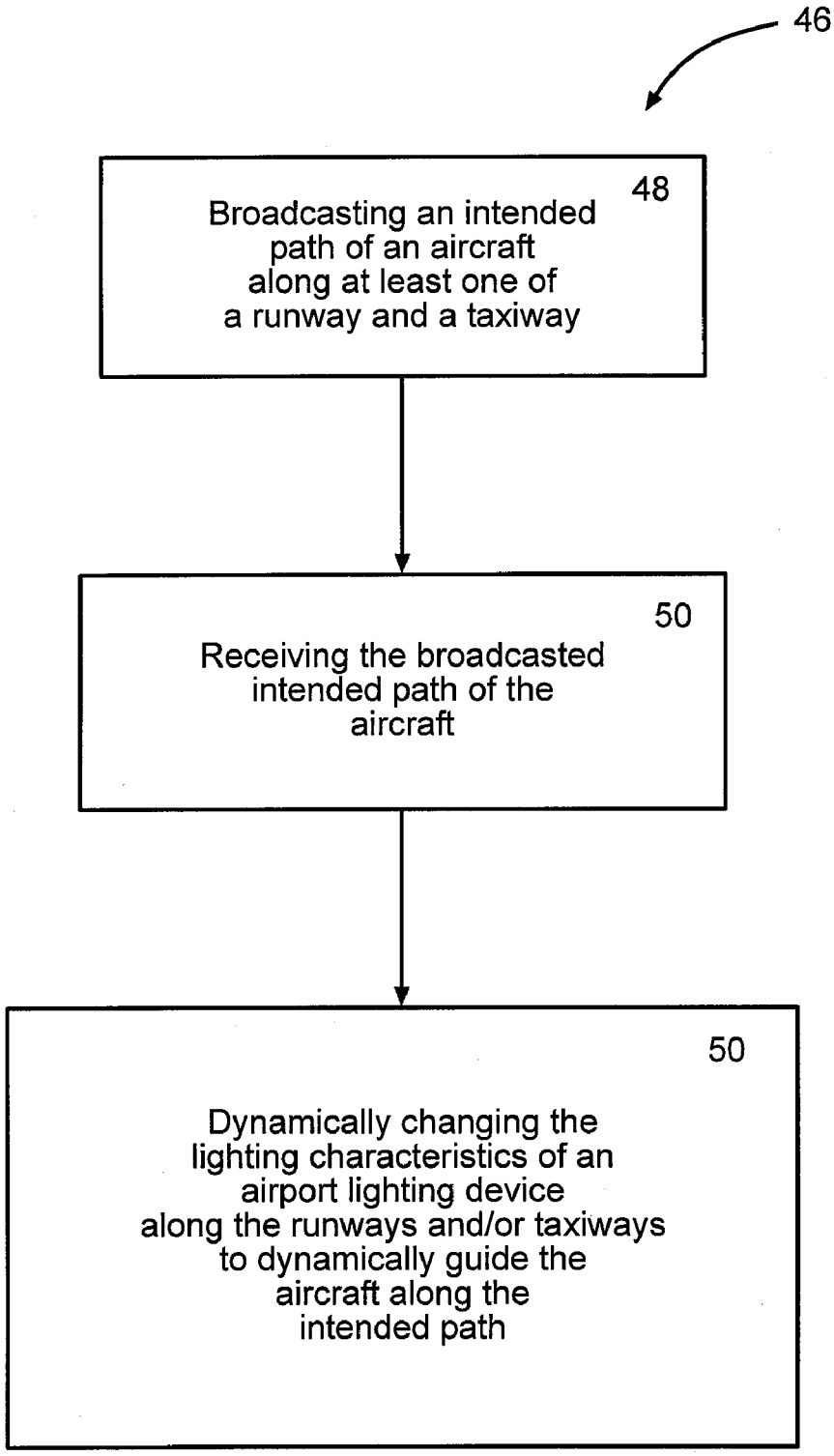
FIG. 2 shows a flowchart of one embodiment of a method of dynamically guiding an aircraft.

FIG. 2 is a flowchart 46 showing one embodiment of a method of dynamically guiding an aircraft 20. In one step 48, an intended path 18 of the aircraft 20 may be broadcasted along at least one of a runway 22 and/or a taxiway 24. Step 48 may utilize a broadcast device 12 which may be disposed on the aircraft 20 and/or in an air traffic control center 28. The broadcast device 12 may comprise and/or utilize a flight management system 26, a data-link system 30, an automatic dependent surveillance broadcast system 32, and/or another type of device and/or system. In one embodiment of step 48 an identification of the aircraft 20 may be broadcast, a location of the aircraft 20 may be broadcast, and/or an intended path 18 of the aircraft may be broadcast along the at least one runway 22 and/or taxiway 24. The broadcasted intended path 18 of the aircraft 20 may comprise at least one of the specific runways 22 and the specific taxiways 24 the aircraft 20 intends to take during at least one of push-off from a gate 34, taxing to the runways 22, moving over the runways 22 to arrive at a take-off runway 22, landing on a landing runway 22, moving over the runways 22 to arrive at a taxiway 24, and moving over the taxiways 24 to arrive at a destination gate 34.

In still another embodiment, the broadcasted intended path 18 of the aircraft 20 may comprise the precise entire departure path of the aircraft 20 from pushing off from a specific gate 34, to taxing along a certain order of particular taxiways 24, to moving along a certain order of particular runways 22, to taking off from a particular take-off position on a particular runway 22. In yet another embodiment, the broadcasted intended path 18 of the aircraft may comprise the precise entire arrival/landing path of the aircraft 20 from landing at a particular landing position on a specific landing runway 22, to moving over a certain order of particular runways 22, to taxing along a certain order of taxiways 24, to arriving at a certain destination gate 34.

In another step 50, the broadcasted intended path 18 of the aircraft 20 along the at least one runway 22 and/or taxiway 24 may be received. In one embodiment of step 50 the identification of the aircraft 20 may be received, the location of the aircraft 20 may be received, and/or the intended path 18 of the aircraft 20 along the at least one runway 22 and/or taxiway 24 may be received.

Figure 3:
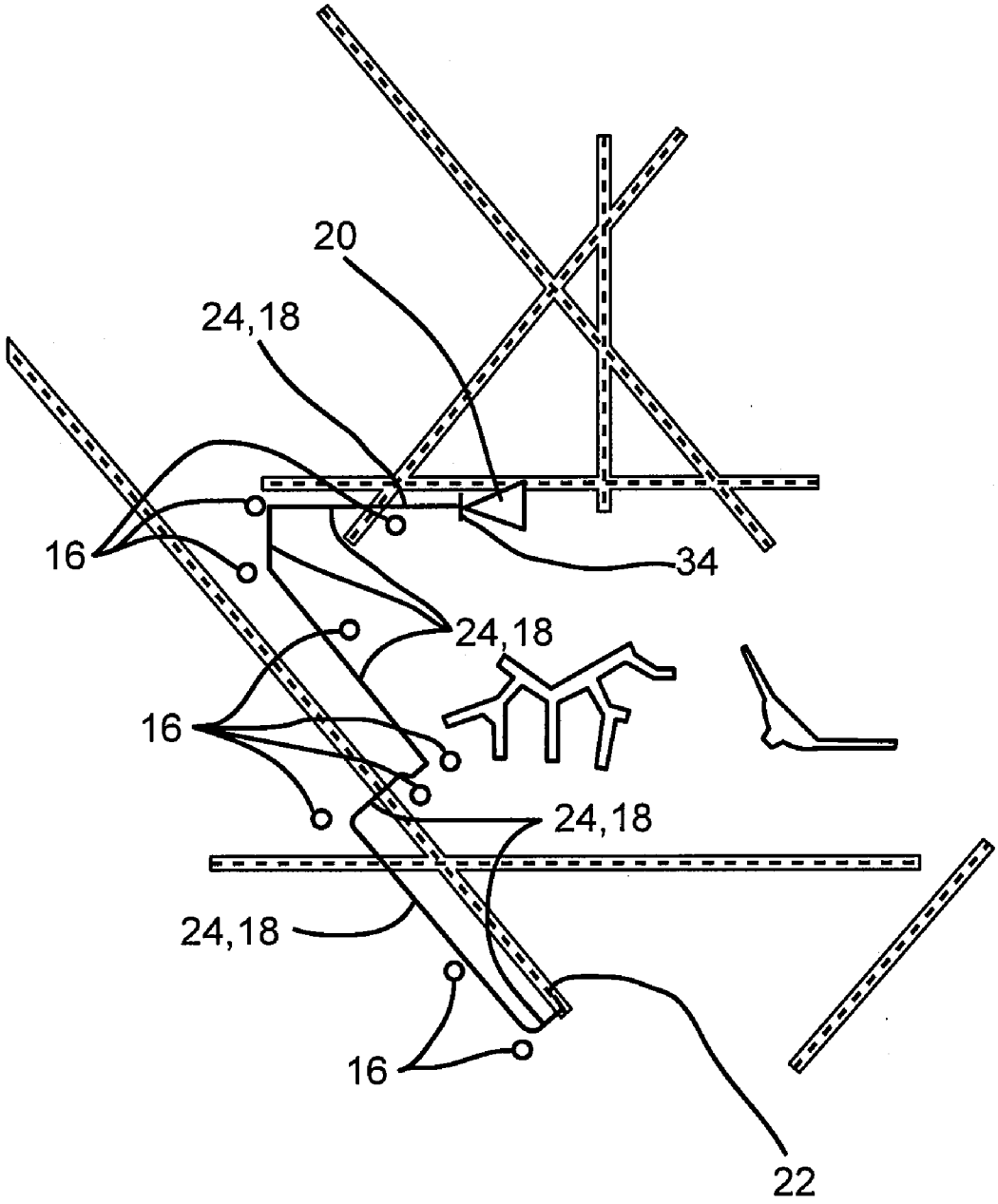
FIG. 3 shows a top view of an airport runway/taxiway system under one embodiment of an aircraft being guided from a gate to a take-off position.
Figure 4:
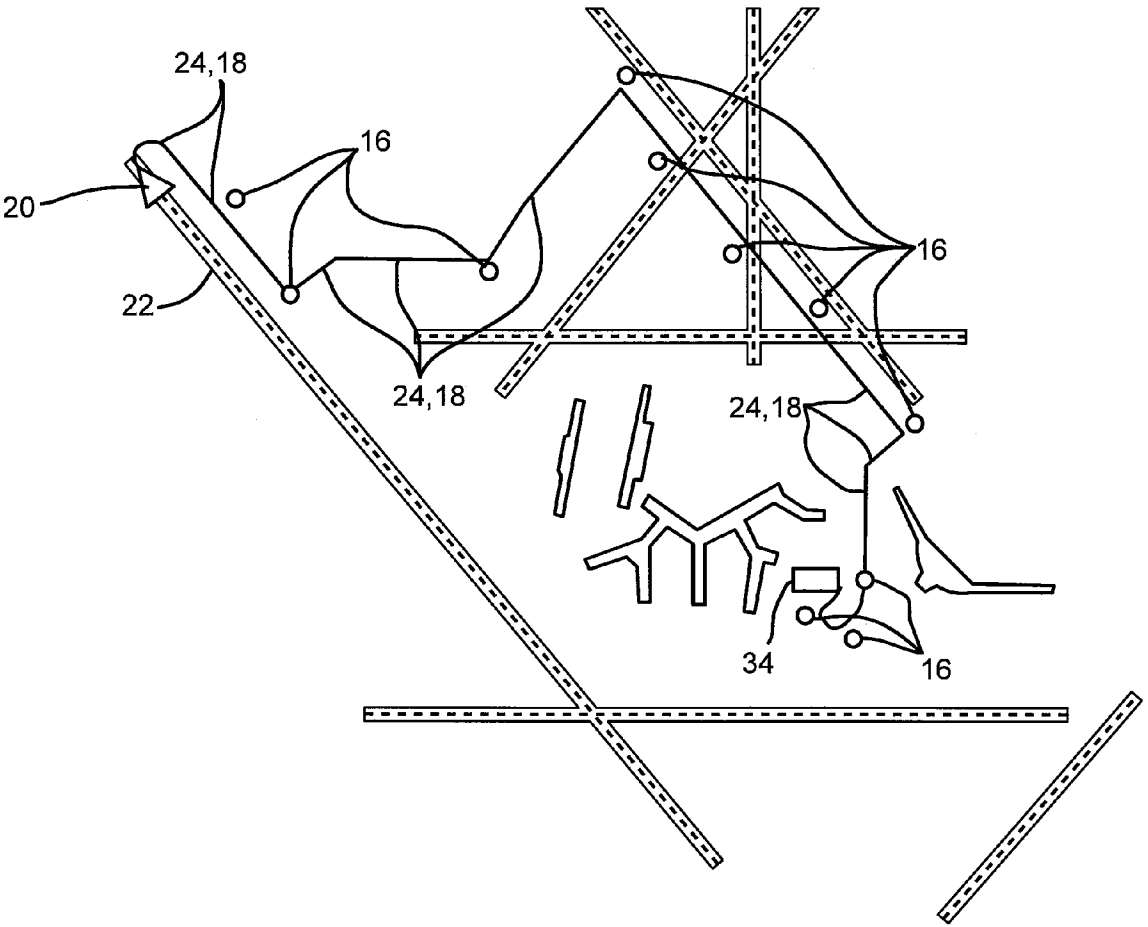
FIG. 4 shows a top view of an airport runway/taxiway system under another embodiment of an aircraft being guided from a landing position to a destination gate.

In an additional step 52, the lighting characteristics 36 of an airport lighting device 16 may be dynamically changed along the at least one runway 22 and/or taxiway 24 to dynamically guide the aircraft 20 along the broadcasted and received intended path 18 of the runway 22 and/or taxiway 24. Step 52 may utilize optimum runway exiting 39 to exit the aircraft 20 off a landing runway 22 to a taxiway 24 as quickly as possible. An autobraking system 44 of the aircraft 20 may be pre-programmed to exit the landing runway 22 at a pre-defined landing runway taxiway 24 exit. In one embodiment, as shown in FIG. 3 which is a top view of an airport runway/taxiway system, the airport lighting device 16 may dynamically guide the aircraft 20 along the intended path 18 from pushing off from a gate 34, along the taxiways 24, along the runways 22, to a take-off position. In still another embodiment, as shown in FIG. 4 which is a top view of another airport runway/taxiway system, the airport lighting device 16 may dynamically guide the aircraft 20 along the intended path 18 from a landing position, along the runways 22, along the taxiways 24, to a destination gate 34.

In yet another embodiment of step 52, the airport lighting device 16 may dynamically change the lighting characteristics 36 of the airport lighting device 16 to provide at least one of dynamic runway center-line lighting 38, dynamic taxiway lead-out lighting 40, and dynamic runway lead-on lighting 42 to guide the aircraft 20 along the intended path 18. In an additional embodiment of step 52, the airport lighting device 16 may dynamically change its lighting characteristics 36 by at least one of increasing lighting intensity, sequential flashing, flashing, color enhancements, enhancements, lighting up arrow directions, lighting up word directions, and lighting up path directions in order to dynamically guide the aircraft 20 along the intended path 18.

One or more embodiments of the disclosure may, by dynamically changing the lighting characteristics of the runway and/or taxiway lighting to dynamically guide the particular aircraft over the intended runway and/or taxiway path intended for that particular aircraft, lead to increased efficiency, less congestion, increased safety, and/or reduce one or more other problems of one or more of the prior art systems and/or methods.

It should be understood, of course, that the foregoing relates to exemplary embodiments of the disclosure and that modifications may be made without departing from the spirit and scope of the disclosure as set forth in the following claims.

The invention claimed is:

1. An airport lighting system comprising:

a broadcast device comprising an automatic dependent surveillance broadcast system disposed on an aircraft for broadcasting an intended path of the aircraft comprising: (1) from a push-off gate, along a taxiway, along a runway, to a take-off position; or (2) from a landing position, along the runway, along the taxiway, to a destination gate;

a receiving device for receiving, from the broadcast device, the broadcasted intended path of the aircraft; and an airport lighting device, connected to the receiving device, for dynamically changing lighting characteristics of the airport lighting device along the broadcasted and received intended path of the aircraft to dynamically guide the aircraft along the broadcasted and received intended path.

2. The airport lighting system of claim 1 wherein the airport lighting device dynamically changes the lighting characteristics of the airport lighting device along the broadcasted and received intended path of the aircraft by using at least one of changing lighting intensity, flashing, sequential flashing, color changes, lighting word directions, lighting arrow directions, or lighting path directions in order to dynamically guide the aircraft along the broadcasted and received intended path.

3. The airport lighting system of claim 1 wherein the broadcast device further comprises a flight management system.

4. The airport lighting system of claim 1 wherein the airport lighting system dynamically changes the lighting characteristics of the airport lighting device by color changes in order to dynamically guide the aircraft along the broadcasted and received intended path.

5. The airport lighting system of claim 1 wherein the airport lighting device utilizes optimum runway exiting to exit the aircraft off the runway to the taxiway.

6. The airport lighting system of claim 1 wherein the airport lighting system dynamically changes the lighting characteristics of the airport lighting device by flashing in order to dynamically guide the aircraft along the broadcasted and received intended path.

7. The airport lighting system of claim 1 wherein the broadcast device is further for broadcasting an identification of the aircraft, and a location of the aircraft, and the receiving device is further for receiving the identification of the aircraft, and the location of the aircraft.

8. The airport lighting system of claim 1 wherein the receiving device is directly connected to the airport lighting device.

9. The airport lighting system of claim 1 wherein the airport lighting device dynamically changes the lighting characteristics of the airport lighting device along the broadcasted and received intended path to provide at least one of dynamic runway center-line lighting, dynamic taxiway lead-out lighting, or dynamic runway lead-on lighting to guide the aircraft along the broadcasted and received intended path.

10. The airport lighting system of claim 1 wherein the aircraft comprises an autobraking system which is pre-programmed to exit the runway at a pre-defined landing runway taxiway exit.

11. The airport lighting system of claim 1 wherein the airport lighting system dynamically changes the lighting characteristics of the airport lighting device along the broadcasted and received intended path of the aircraft by changing lighting intensity in order to dynamically guide the aircraft along the broadcasted and received intended path.

12. The airport lighting system of claim 1 wherein the airport lighting system dynamically changes the lighting characteristics of the airport lighting device along the broadcasted and received intended path by using sequential flashing in order to dynamically guide the aircraft along the broadcasted and received intended path.

13. The airport lighting system of claim 1 wherein the airport lighting system dynamically changes the lighting characteristics of the airport lighting device along the broadcasted and received intended path by lighting up path directions in order to dynamically guide the aircraft along the broadcasted and received intended path.

14. The airport lighting system of claim 13 wherein the airport lighting system dynamically changes the lighting characteristics of the airport lighting device along the broadcasted and received intended path by lighting up the path directions, using at least one of lighted arrow directions or lighted word directions, in order to dynamically guide the aircraft along the broadcasted and received intended path.

15. A computer-implemented method of dynamically guiding an aircraft comprising:

broadcasting an intended path of the aircraft, comprising: (1) from a push-off gate, along a taxiway, along a runway, to a take-off position; or (2) from a landing position, along the runway, along the taxiway, to a destination gate, using a broadcast device comprising an automatic dependent surveillance broadcast system disposed on the aircraft;

receiving, using a receiving device, the broadcasted intended path, broadcasted by the broadcast device, of the aircraft; and dynamically changing lighting characteristics of an airport lighting device, connected to the receiving device, to dynamically guide the aircraft along the broadcasted and received intended path.

16. The computer-implemented method of claim 15 wherein the step of dynamically changing lighting characteristics of the airport lighting device comprises at least one of changing lighting intensity, flashing, sequential flashing, color changes, lighting word directions, lighting arrow directions, or lighting path directions to dynamically guide the aircraft along the broadcasted and received intended path.

17. The computer-implemented method of claim 15 wherein the broadcast device further comprises a flight management system.

18. The computer-implemented method of claim 15 wherein the step of dynamically changing lighting characteristics of the airport lighting device comprises color changes to dynamically guide the aircraft along the broadcasted and received intended path.

19. The computer-implemented method of claim 15 wherein the step of dynamically changing lighting characteristics of the airport lighting device utilizes optimum runway exiting to exit the aircraft off the runway to the taxiway.

20. The computer-implemented method of claim 15 wherein the step of dynamically changing lighting characteristics of the airport lighting device comprises flashing to dynamically guide the aircraft along the broadcasted and received intended path.

21. The computer-implemented method of claim 15 wherein the broadcasting step further comprises broadcasting an identification of the aircraft, and a location of the aircraft, and the receiving step further comprises receiving the identification of the aircraft, and the location of the aircraft.

22. The computer-implemented method of claim 15 wherein during the dynamically changing lighting characteristics step the airport lighting device dynamically changes the lighting characteristics to provide at least one of dynamic runway center-line lighting, dynamic taxiway lead-out lighting, or dynamic runway lead-on lighting to guide the aircraft along the broadcasted and received intended path.

23. The computer-implemented method of claim 15 further comprising pre-programming an autobraking system of the aircraft to exit the runway at a pre-defined landing runway taxiway exit.

24. The computer-implemented method of claim 15 wherein during the dynamically changing lighting characteristics step the airport lighting device dynamically changes lighting intensity in order to dynamically guide the aircraft along the broadcasted and received intended path.

25. The computer-implemented method of claim 15 wherein during the dynamically changing lighting characteristics step the airport lighting device uses sequential flashing in order to dynamically guide the aircraft along the broadcasted and received intended path.

26. The computer-implemented method of claim 15 wherein during the dynamically changing lighting characteristics step the airport lighting device lights up path directions in order to dynamically guide the aircraft along the broadcasted and received intended path.

27. The computer-implemented method of claim 26 wherein during the dynamically changing lighting characteristics step the airport lighting device lights up the path directions, using at least one of lighted arrow directions or lighted word directions, in order to dynamically guide the aircraft along the broadcasted and received intended path.

28. The computer-implemented method of claim 15 wherein the receiving device is directly connected to the airport lighting device.

29. An airport lighting system comprising:

a broadcast device comprising an automatic dependent surveillance broadcast system disposed on an aircraft for broadcasting an intended path of the aircraft comprising: (1) from at least one of a push-off gate, a taxiway, or a runway, to a take-off position; or (2) from a landing position to at least one of the runway, the taxiway, or a destination gate;

a receiving device for receiving, from the broadcast device, the broadcasted intended path of the aircraft; and an airport lighting device, connected to the receiving device, for dynamically changing lighting characteristics of the airport lighting device along the broadcasted and received intended path of the aircraft to dynamically guide the aircraft along the broadcasted and received intended path.

30. A computer-implemented method of dynamically guiding an aircraft comprising:

broadcasting an intended path of the aircraft, comprising: (1) at least one of a push-off gate, a taxiway, or a runway, to a take-off position; or (2) from a landing position to at least one of the runway, the taxiway, or a destination gate, using a broadcast device comprising an automatic dependent surveillance broadcast system disposed on the aircraft;

receiving, using a receiving device, the broadcasted intended path, broadcasted by the broadcast device, of the aircraft; and dynamically changing lighting characteristics of an airport lighting device, connected to the receiving device, to dynamically guide the aircraft along the broadcasted and received intended path.

31. An airport lighting system comprising:

a broadcast device, comprising an automatic dependent surveillance broadcast system disposed on an aircraft, for broadcasting an intended path of the aircraft comprising at least one of a runway or a taxiway the aircraft intends to take during at least one of push-off from a push-off gate, taxing along the taxiway to a take-off runway, moving over the take-off runway to arrive at a take-off position, landing on a landing runway, moving over the landing runway to arrive at the taxiway, or moving over the taxiway to arrive at a destination gate;

a receiving device for receiving, from the broadcast device, the broadcasted intended path of the aircraft along the at least one runway or taxiway; and an airport lighting device, connected to the receiving device, for dynamically changing lighting characteristics of the airport lighting device along the at least one runway or taxiway in order to dynamically guide the aircraft along the broadcasted and received intended path of the aircraft from pushing off from the push-off gate, taxing along the taxiway to the take-off runway, moving over the take-off runway to the take-off position, or dynamically changes the lighting characteristics of the airport lighting device to dynamically guide the aircraft along the broadcasted and received intended path from a landing position, along the landing runway, along the taxiway, to the destination gate.

32. A computer-implemented method of dynamically guiding an aircraft comprising:

broadcasting an intended path of the aircraft using a broadcast device, comprising an automatic dependent surveillance broadcast system disposed on the aircraft, wherein the broadcasted intended path of the aircraft comprises at least one of a runway or a taxiway the aircraft intends to take during at least one of push-off from a push-off gate, taxing along the taxiway to a take-off runway, moving over the take-off runway to arrive at a take-off position, landing on a landing runway, moving over the landing runway to arrive at the taxiway, or moving over the taxiway to arrive at a destination gate;

receiving, using a receiving device, the broadcasted intended path, broadcasted by the broadcast device, of the aircraft along the at least one runway or taxiway; and dynamically changing lighting characteristics of an airport lighting device, connected to the receiving device, along the at least one runway or taxiway to dynamically guide the aircraft along the broadcasted and received intended path, using a micro-controller, from pushing off from the push-off gate, taxing along the taxiway to the take-off runway, moving over the take-off runway to the take-off position, or dynamically guides the aircraft along the broadcasted and received intended path from a landing position, along the landing runway, along the taxiway, to the destination gate.

* * * * *